US007727012B2

(12) United States Patent
Montena et al.

(10) Patent No.: US 7,727,012 B2
(45) Date of Patent: Jun. 1, 2010

(54) RADIAL AND THRUST SNAP BEARING RETAINER

(75) Inventors: Noah Montena, Syracuse, NY (US); Shawn Chawgo, Cicero, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 9 days.

(21) Appl. No.: 11/553,139

(22) Filed: Oct. 26, 2006

(65) Prior Publication Data

US 2008/0102697 A1 May 1, 2008

(51) Int. Cl.
*H01R 9/05* (2006.01)

(52) U.S. Cl. ..... 439/578

(58) Field of Classification Search ..... 439/578–585, 439/491, 322, 350

See application file for complete search history.

(56) References Cited

U.S. PATENT DOCUMENTS

| | | | | |
|---|---|---|---|---|
| 4,789,351 | A * | 12/1988 | Fisher et al. | 439/248 |
| 5,938,465 | A * | 8/1999 | Fox, Sr. | 439/350 |
| 6,491,546 | B1 | 12/2002 | Perry | |
| 6,709,289 | B2 * | 3/2004 | Huber et al. | 439/578 |
| 6,712,631 | B1 * | 3/2004 | Youtsey | 439/322 |
| 7,182,628 | B2 * | 2/2007 | Holliday | 439/491 |

* cited by examiner

*Primary Examiner*—Edwin A. Leon
(74) *Attorney, Agent, or Firm*—Hiscock & Barclay, LLP

(57) ABSTRACT

The invention provides a connector for coax cable with a snap bearing providing the interface between the inner body and the outer body. A concave surface below the snap bearing, which is retained by a pair of shoulders, allows the snap bearing to elastically deform during assembly of the connector to thereby reduce the risk of plastic deformation of the components while allowing significant improvements in overlap at the interface of the components.

22 Claims, 5 Drawing Sheets

RADIAL AND THRUST SNAP BEARING RETAINER

FIELD OF THE INVENTION

This invention relates to connector bodies for coaxial cables.

BACKGROUND OF THE INVENTION

For small assemblies, such as coaxial connectors, it is often desirable to use components that are configured to snap together rather than use fasteners. In certain connectors, two parts that are to rotate relative to one another are snapped together with a snap ridge of one part engaging a groove in the other part. The overlap between the components in such connections is typically kept to a minimum, such as a few thousandths of an inch of overlap in brass components, in order to minimize plastic deformation of the components during assembly. The minimal overlap results in high bearing pressures and high friction forces in the interface between the components resulting in wear and degradation of the snap ridge. A terminator connector having a snap fit between an outer body and an inner body is described in U.S. Pat. No. 6,491,546, issued to Jason Perry, the disclosure of which is herein incorporated by reference.

Snap bearings may be used to allow the rotation of one part with respect to another while substantially increasing the overlap between the components. A typical snap bearing is split to allow the bearing to be stretched over a ridge during assembly. However, radial loads, such as those applied during assembly, may cause deformation of conventional snap bearings.

Therefore, an improved interface between components in a coax connector with increased overlap and reduced risk of plastic deformation of the components is desired.

SUMMARY OF THE INVENTION

The invention is a coaxial cable connector having a snap bearing interface between an inner body and an outer body, wherein the outer body is rotatable about the inner body. The bearing is a split snap bearing with a ridge for engaging a groove in the outer body. The snap bearing is retained between two shoulders on the outer surface of the inner body with a concave surface between the shoulders and below the bearing's ridge. The edges of the bearing are supported by a ledge proximate to each of the shoulders. Thus, the snap bearing provides radial and axial support for the outer body.

In one form, the invention includes a coaxial cable connector comprising an inner body with an outer surface having a retaining shoulder, a snap shoulder, and a concave surface therebetween; and a split bearing engaging the inner body between the retaining shoulder and the snap shoulder.

In another form, the invention includes a coaxial cable connector that comprises an outer body with an inner surface having a retaining shoulder, a snap shoulder, and a concave surface therebetween; and a split bearing engaging the outer body between the retaining shoulder and the snap shoulder.

In another form, the invention includes a coaxial cable connector comprising an inner body, an outer body that is coupled to the inner body, an interface between the inner body and the outer body having a retaining shoulder, a snap shoulder, and a concave surface therebetween, and a split bearing engaging the interface between the retaining shoulder and the snap shoulder.

In another form, the invention includes a method for assembling a coaxial cable connector. The method comprises the steps of providing an inner body having a concave surface and a snap shoulder; sliding a split bearing over the snap shoulder to substantially cover the concave surface, the split bearing having a ridge projecting away from the concave surface; and inserting the inner body into an outer body such that the outer body contacts the ridge and deflects the split bearing toward the concave surface until the ridge engages a groove defined by the outer body.

An advantage of the present invention is that the concave surface allows the center span of the snap bearing to flex during assembly of the components of the connector without exceeding the elastic limit of the bearing. The concave surface thus allows for a large bearing surface, thus reducing the bearing pressures on the components.

BRIEF DESCRIPTION OF THE DRAWINGS

The present invention is disclosed with reference to the accompanying drawings, wherein.

Corresponding reference characters indicate corresponding parts throughout the several views. The examples set out herein illustrate several embodiments of the invention but should not be construed as limiting the scope of the invention in any manner.

DETAILED DESCRIPTION

Figure 1:
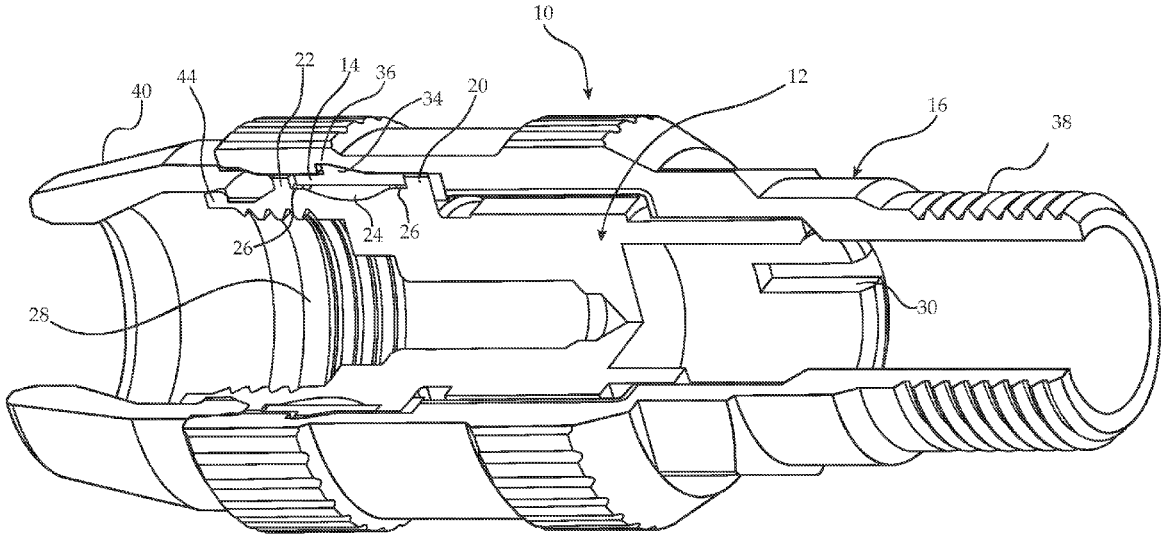
FIG. 1 is a partially cut-away isometric view of the coaxial connector of the present invention.

FIG. 1 shows the coaxial connector of the present invention. By way of example, the connector described is a tamper-resistant terminator connector, though the invention may also be applied to other coax connectors having an outer part that rotates relative to an inner part. The connector 10 includes an inner body 12, a snap bearing 14, and an outer body 16.

Figure 2:
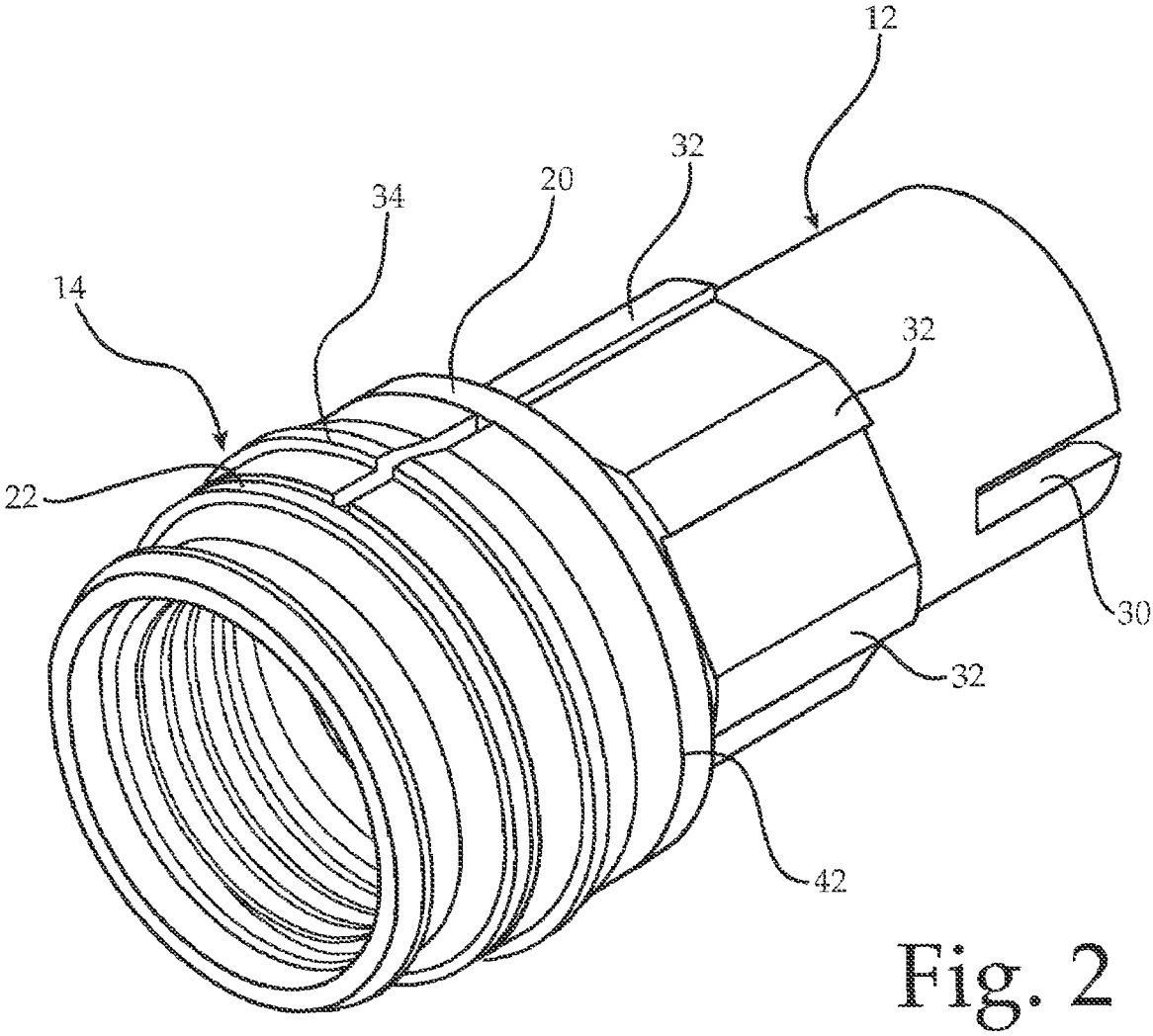
FIG. 2 is an isometric view of the inner body and snap bearing of the present invention.
Figure 3:
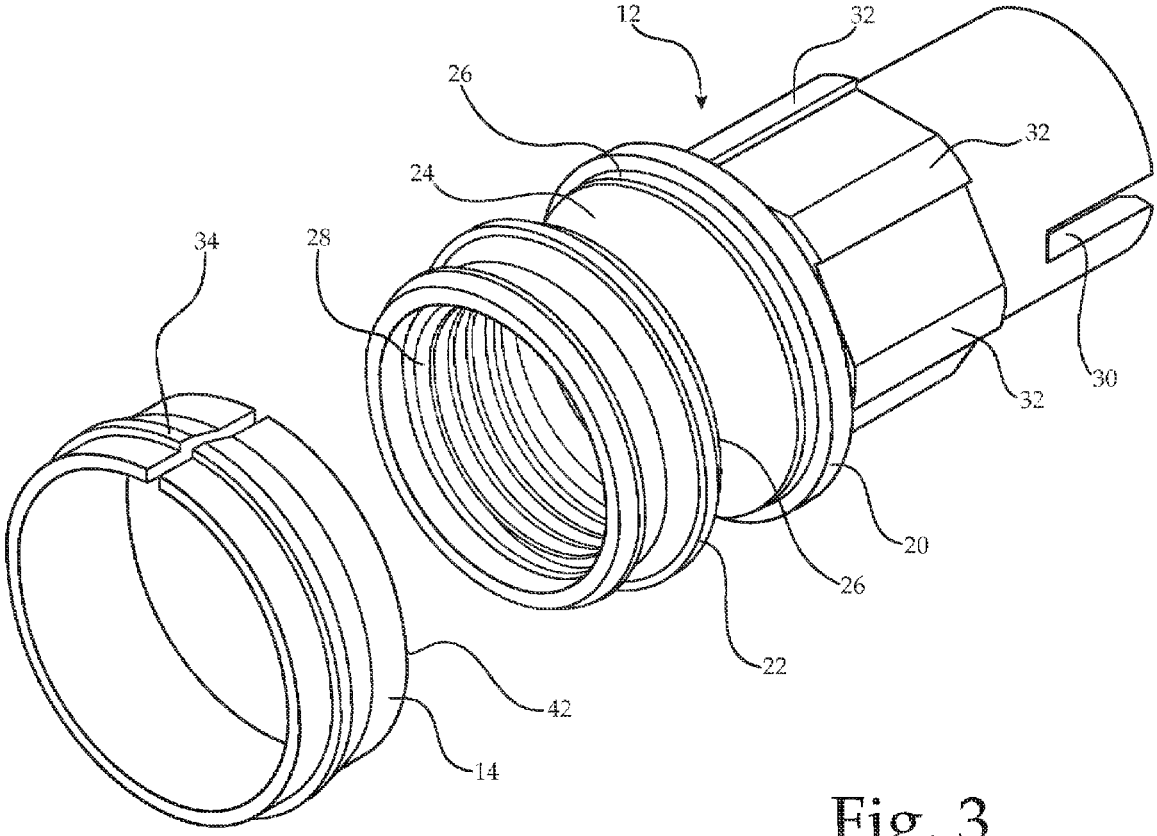
FIG. 3 is an isometric view of the inner body and the unassembled snap bearing of FIG. 2.
Figure 4:
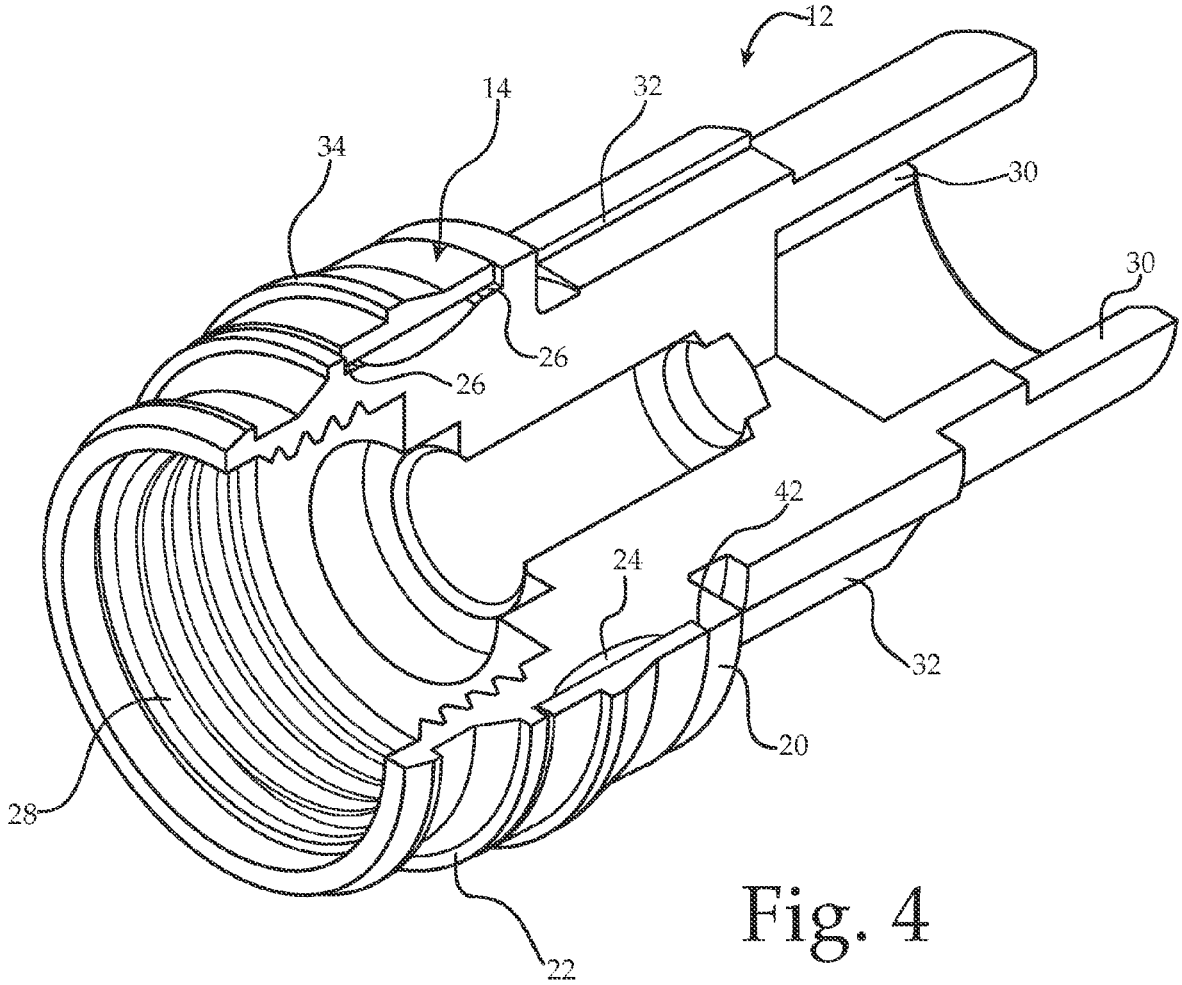
FIG. 4 is a partially cut-away isometric view of the inner body and snap bearing of FIG. 2.
Figure 5:
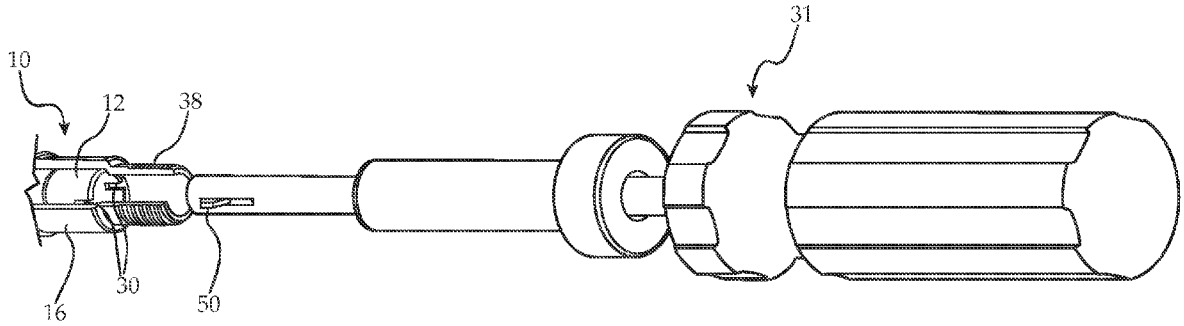
FIG. 5 is a an isometric view showing the connector and the specialized tool.

The inner body 12, as shown in FIGS. 2 and 3, includes a retaining shoulder 20, a snap shoulder 22, and a concave surface 24. The concave surface 24 includes an edge 26 proximate to each of the retaining shoulder 20 and the snap shoulder 22. In a particular embodiment, the edges 26 are narrow with respect to the concave surface 24 as illustrated in the figures. The inner body 12 further includes inner threads 28 configured for engaging a coaxial port (not shown) and slots 30 configured for engaging a specialized tool 31 (FIG. 5) for threading the threads 28 onto the coaxial port after the terminator connector 10 has been assembled. The specialized tool 31 is of the type that are generally available to cable installers, but not the general public. The tool 31 includes a pair of spring-loaded feet 50 that may be inserted into the end of the terminator connector 10 to engage the slots 30.

The optional ramps 32 engage fingers (not shown) on the inner surface of the outer body 16 to allow the outer body 16 to rotate about the inner body 12 in one direction only. The inner body 12 may be configured for receiving a resistor case with a resistor that engages the center conductor of the coax port when the terminator connector is affixed to the coax port. The resistor is chosen to have a similar impedance as coaxial cable, such as 75-Ω, to properly terminate the port. The inner body 12 further includes an interior transverse wall for preventing access to the coax port through the terminator connector 10. The inner body 12 may be made of a metal, such as brass, or other suitable materials, such as Ultem™, a durable platic, and glass-filled polycarbonate.

The snap bearing 14 is a split bearing having a ridge 34 on the outer surface thereof. The ridge 34 is ramped in the illustrated embodiment to allow easier assembly of the outer body 16 onto the snap bearing 14 and to provide axial support to the outer body 16 in one direction. In an alternative embodiment, the ridge 34 is not ramped to thereby provide axial support to the outer body 16 in two directions. In a particular embodiment, the snap bearing 14 comprises a substantially high strength plastic, such as acetal, or metal having a lubricious coating or plating to maximize the reduction of friction of the bearing.

The outer body 16, shown in FIG. 1, includes a groove 36 corresponding to the ridge 34 and outer threads 38 configured for engaging the outer threads of a coaxial cable. The outer body 16 is made of metal, such as brass, or another substantially rigid material, such as Ultem™ or glass-filled polycarbonate. The outer body 16 generally follows the contours of the inner body 12 while providing clearance between the inner body 12 and the outer body 16. A connector cap 40 includes an end that snaps onto the inner body 12 proximate to the inner threads 28.

The terminator connector is assembled by stretching the snap bearing 14 such that the leading edge 42 fits over the snap shoulder 22 and then forcing the snap bearing 14 forward so that the bearing slides over the snap shoulder 22 and snaps into place between the retaining shoulder 20 and the snap shoulder 22 as shown in FIG. 2. The leading edge 42 may pivot downward toward the concave surface 24 during assembly to minimize the strain on the snap bearing 14. The invention thus reduces the risk of reaching the elastic limit of the snap bearing 14 during assembly by providing the concave surface 24. The edges 26 support the snap bearing 14. The connector cap 40 is assembled by snapping onto a barb 44 external to the threads 28.

The outer body 16 is assembled by inserting the end of the inner body 12 having the slots 30 into the axial bore of the outer body 16 until the leading end of the outer body 16 slides over the ridge 34 and the ridge 34 snaps into the groove 36. As the leading end of the outer body 16 slides over the ridge 34, the snap bearing 14 is able to elastically deform downward toward the concave surface 24 thus avoiding potential permanent deformation of the ridge 34 or the snap bearing 14 as a whole.

In use, the feet 50 extending from the specialized tool 31 engage the slots 30 via the axial bore of the outer body 16 proximate to the outer threads 38. The tool is used to tighten the inner threads 28 onto the coax port. The terminator connector 10 is now connected to the coax port in a tamper-proof way since the inner body 12 is completely encompassed by the outer body 16 and the outer body 16 is free to rotate about the inner body 12 via the snap bearing 14. The only way to turn the inner body 12 and thus loosen it from the coax port is to use the specialized tool 31 to engage the slots 30. Thus, unauthorized personnel without access to the tool 31 cannot access the coaxial port with a coaxial cable. In certain situations, such as when a cable is being temporarily disconnected, the disconnected cable may be connected to the outer body 16 by threading the cable's connector onto the outer threads 38. The disconnected cable is isolated from the coaxial port by the terminator connector.

In an alternative embodiment, the snap bearing is inverted and the retaining shoulder, the snap shoulder, and the concave surface are located on the interior of the outer body. The snap bearing's ridge thus is directed inward and engages a corresponding groove in the outer surface of the inner body. The terminator connector of the alternative embodiment is assembled similarly as described in the previous embodiment, except that the snap bearing is first assembled into the space between the snap shoulder and the retainer shoulder of the outer body.

It should be particularly noted that although the snap bearing retainer of the present invention is shown and described as applied to a tamper-resistant terminator connector, the invention may also be used with other connector types requiring a bearing that provides radial support, axial support, or both.

While the invention has been described with reference to preferred embodiments, it will be understood by those skilled in the art that various changes may be made and equivalents may be substituted for elements thereof to adapt to particular situations without departing from the scope of the invention. Therefore, it is intended that the invention not be limited to the particular embodiments disclosed as the best mode contemplated for carrying out this invention, but that the invention will include all embodiments falling within the scope and spirit of the appended claims.

PARTS LIST

10 coax connector
12 inner body
14 snap bearing
16 outer body
20 retaining shoulder
22 snap shoulder
24 concave surface
26 edge
28 inner threads
30 slots
31 specialized tool
32 ramps
34 ridge
36 groove
38 outer threads
40 conductor cap
42 leading edge
44 barb
50 spring-loaded feet of the specialized tool

The invention claimed is:

1. A coaxial cable connector, comprising:

an outer body;

an inner body disposed within a center passageway of said outer body, said inner body comprising an outer surface having a retaining shoulder, a snap shoulder, and a concave surface disposed therebetween; and a snap bearing engaging said inner body between the retaining shoulder and the snap shoulder, the snap bearing and the concave surface defining a first space therebetween;

wherein said snap bearing comprises an exterior ridge sized to engage a corresponding groove defined by said outer body, said connector further including ledges adjacent the retaining shoulder and snap shoulder, respectively, that support opposing edges of the snap bearing.

2. The coaxial cable connector of claim 1, said snap bearing being wide in comparison to the thickness of said snap bearing.

3. The coaxial cable connector of claim 1, said snap bearing being a thrust bearing providing radial and axial support for said outer body.

4. The coaxial cable connector of claim 1, the exterior ridge, and corresponding groove each having a ramped side for engagement therebetween.

5. The coaxial cable connector of claim 1, wherein the ledges are narrow with respect to the width of the concave surface.

6. The coaxial cable connector of claim 1, said snap bearing being made of a high-strength plastic.

7. The coaxial cable connector of claim 6, wherein the plastic is acetal.

8. The coaxial cable connector of claim 1, said snap bearing and said inner body being made of metal.

9. The coaxial cable connector of claim 8, wherein the metal is brass.

10. The coaxial cable connector of claim 8, said snap bearing having a friction-reducing material applied thereto.

11. The coaxial cable connector of claim 10, wherein the friction-reducing material is nickel-Teflon.

12. The coaxial cable connector of claim 1, said connector being a terminator connector.

13. The coaxial cable connector of claim 12, said inner body comprising slots for engaging a specialized tool that installs said inner body on a coaxial port in a tamper-resistant way.

14. A coaxial cable connector, comprising:

an inner body;

an outer body comprising an inner surface having a retaining shoulder, a snap shoulder, and a concave surface disposed therebetween; and a snap bearing engaging said outer body between the retaining shoulder and the snap shoulder, the snap bearing and the concave surface defining a first space therebetween;

wherein said snap bearing comprises an interior ridge engaging a corresponding groove defined in said inner body, said connector further including ledges adjacent the retaining shoulder and snap shoulder, respectively, in which said ledges support opposing edges of the snap bearing.

15. The coaxial cable connector of claim 14, said snap bearing being made of a high-strength plastic.

16. The coaxial cable connector of claim 14, said snap bearing and said outer body being made of metal.

17. The coaxial cable connector of claim 16, said snap bearing having a friction-reducing material applied thereto.

18. A coaxial cable connector comprising:

an outer body having a longitudinal axis, and an internal passageway defined therein;

an inner body configured for insertion into the internal passageway of said outer body, the inner body comprising:

a retaining shoulder at one end;

a snap shoulder at an opposing end;

a concave surface between the retaining shoulder and the snap shoulder; and, a snap bearing movable between a pre-assembled position and an assembled position, the snap bearing and concave surface defining a first open space therebetween, wherein in the pre-assembled position a leading edge of the snap bearing pivots inwardly toward the concave surface and wherein in the assembled position the leading edge of the snap bearing pivots outwardly to engage the retaining shoulder, said connector further including ledges adjacent the snap shoulder and retaining shoulder, respectively, said ledges supporting opposing edges of said snap bearing in the assembled position.

19. The coaxial cable connector of claim 18, the snap bearing being wide in comparison to the thickness of said snap bearing.

20. The coaxial cable connector of claim 18, the internal passageway of the outer body having a groove for engaging the snap bearing.

21. The coaxial cable connector of claim 20, the snap bearing having a ridge engaging a corresponding groove defined by an outer body.

22. The coaxial cable connector of claim 21, wherein the groove and the ridge each include a ramped side to enable engagement therebetween.

* * * * *